United States Patent [19]

Yasue

[11] Patent Number: 4,856,297

[45] Date of Patent: Aug. 15, 1989

[54] TRANSFER VESSEL DEVICE AND METHOD OF TRANSFER USING THE DEVICE

[75] Inventor: Takao Yasue, Itami, Japan

[73] Assignee: Mitsubishi Denki Kabushiki Kaisha, Japan

[21] Appl. No.: 138,953

[22] Filed: Dec. 29, 1987

[30] Foreign Application Priority Data

Sep. 30, 1987 [JP] Japan ..... 62-243680

[51] Int. Cl.[4] ..... F25B 19/00

[52] U.S. Cl. ..... 62/51.1; 62/383

[58] Field of Search ..... 62/514 R, 383, 45, 78

[56] References Cited

U.S. PATENT DOCUMENTS

| | | | |
|---|---|---|---|
| 3,170,306 | 2/1965 | Gross, Jr. et al. | 62/384 |
| 3,230,727 | 1/1966 | Skinner | 62/45 |
| 3,573,557 | 4/1971 | Riggs | 62/514 R |
| 3,678,704 | 7/1972 | Staas | 62/514 R |
| 3,978,682 | 9/1976 | Severijns et al. | 62/514 R |

OTHER PUBLICATIONS

"Electron Spectroscopy for Chemical Analysis", ULVAC-PHI 5000 Series, ULVAC-PHI, Inc. (No Date Given).

"S-900 Type Hitachi Scanning Electron Microscope", Hitachi Seisakusho Inc. (No Date Given).

"H-9000 Type Hitachi Scanning Electron Microscope", Hitachi Seisakusho Inc. (No Date Given).

*Primary Examiner*—Ronald C. Capossela

*Attorney, Agent, or Firm*—Leydig, Voit & Mayer

[57] ABSTRACT

A transfer vessel device for transporting a specimen between two vacuum apparatuses while maintaining the specimen under a high vacuum. The device comprises a hermetic container for accommodating a specimen removed from a vacuum apparatus and for supporting the specimen; a heat-insulated container in which a cooling medium such as liquid nitrogen is accommodated; and a heat-transfer member which is formed of a highly heat conductive material such as copper and which surrounds the specimen in the hermetic container and has one end leading into the heat-insulated container so as to be cooled by the cooling medium.

9 Claims, 1 Drawing Sheet

TRANSFER VESSEL DEVICE AND METHOD OF TRANSFER USING THE DEVICE

BACKGROUND OF THE INVENTION

1. Field of the Invention

The present invention relates to a transfer vessel device for transferring a specimen between two vacuum apparatuses while maintaining the specimen under a high vacuum. The invention is also concerned with a method of transfer using the device.

2. Description of the Related Art

In general, when a specimen which has been subjected to a various kinds of treatments in a vacuum apparatus having a high or medium degree of vacuum is temporarily removed from that apparatus and is then accommodated again in that vacuum apparatus or in another vacuum apparatus, it is often necessary to transport the specimen without exposing it to the atmosphere, while maintaining it under vacuum. Hitherto, a transfer vessels device, such as the one shown in FIG. 2, has been used to meet this requirement. This transfer vessel device has a container body 1, a coupling portion 2 provided at a lower portion of the container body 1 and adapted to be selectively opened or closed, and a vacuum pump 4 constituted by an ion pump or the like hermetically connected to a side portion of the container body 1 via a connecting portion 3. The coupling portion 2 is hermetically coupled to a vacuum apparatus (not shown) with the coupling portion 2 closed. At the same time, the inside of the container body 1 is evacuated so as to maintain it at a high or medium degree of vacuum. In this state, the coupling portion 2 is opened and a specimen 5 is transferred from the vacuum apparatus to the inside of the container body 1. After the specimen 5 has been supported by a holder 6 which is installed on an inner wall of the container body 1, the coupling portion 2 is closed. Subsequently, the coupling portion 2 is either opened and the specimen 5 is accommodated again in the vacuum apparatus or the coupling portion 2 is separated from the vacuum apparatus and coupled with another vacuum apparatus so that the specimen 5 can be accommodated therein.

Thus, the specimen 5 can be transferred between vacuum apparatuses without it being exposed to the atmosphere.

However, in order to maintain the degree of vacuum inside the container body 1, it is necessary to constantly operate the vacuum pump 4 during transportation by supplying electric power to the vacuum pump 4 from a power source (not shown) via a power cable 7. Since the power source is normally fixed, this method has a drawback in that the range of movement of the transfer body is restricted within the movable range of the power cable 7.

In addition, there is another drawback in that the transfer device is expensive since a vacuum pump is used.

SUMMARY OF THE INVENTION

Accordingly, an object of the present invention is to provide a transporation container device which has excellent transportability and is inexpensive, thereby overcoming the above-described drawbacks of the prior art.

Another object of the present invention is to provide a method of transfer which enables, by the use of the device of the invention, the transportation of a specimen between vacuum appartuses while being maintained under a high vacuum.

To these ends, according to one aspect of the present invention, there is provided a transfer vessel device comprising: a hermetic container for accommodating a specimen removed from a vacuum apparatus and for supporting the specimen; a heat-insulated container in which a cooling medium is accommodated; and a heat-transfer member which surrounds the specimen in the hermetic container and one end of which leads into the heat-insulated container so as to be cooled by the cooling medium.

According to another aspect of the present invention, there is provided a method of transfer in which a specimen is transferred between vacuum apparatuses by using the transfer vessel device of the invention.

Since the lower the temperature, the more the volume of a gas shrinks, the pressure of the gas is reduced when the temperature thereof is lowered with the volume thereof being held constant.

Accordingly, if the atmosphere around the specimen is cooled by the cooling medium via the heat-transfer member, it is possible to lower or maintain the internal pressure of the hermetic container, particularly the pressure of a gas surrounding the specimen. Therefore, the inside of the hermetic container, particularly a portion surrounding the specimen, can be maintained in a desired high degree of vacuum for a long period of time without using a vacuum pump.

The other objects, features and advantages of the present invention will become apparent from the following detailed description of the invention when read in conjunction with the accompanying drawings, in which identical reference numerals denote identical or corresponding portions.

DESCRIPTION OF THE PREFERRED EMBODIMENT

Referring now to the accompanying drawings, description will be made of an embodiment of the invention.

Figure 1:
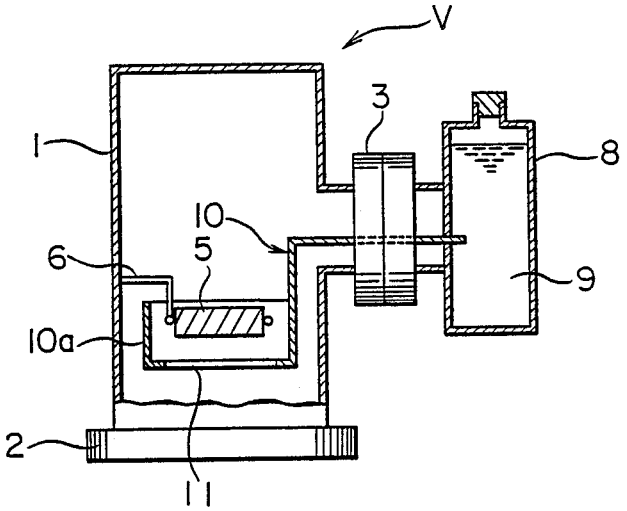
FIG. 1 is a side elevational view, partially in section, of a transfer vessel device in accordance with an embodiment of the present invention.
Figure 2:
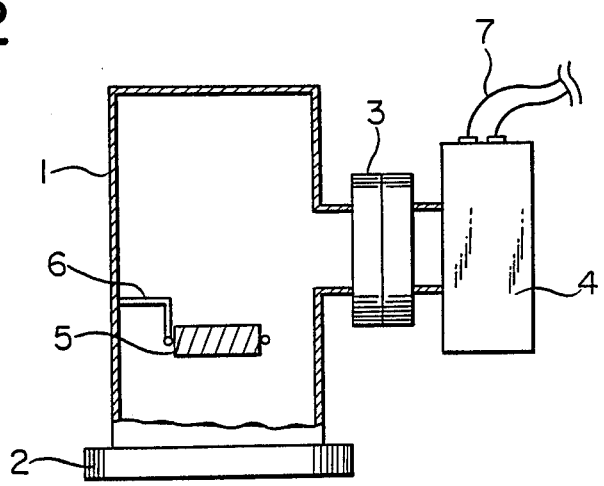
FIG. 2 PRIOR ART
FIG. 2 is a side elevational view, partially in section, of a conventional transfer device.

In FIG. 1, there is schematically illustrated a transfer vessel device constructed in accordance with the present invention which has a cylindrical container body 1, one end of which is closed. At the other open end of the container body 1, a coupling portion 2 is provided which is adapted to be selectively opened and closed. The container body 1 and the coupling portion 2 constitute a hermetic container V. A heat-insulated container 8, in which a cooling medium 9 such as liquid nitrogen is accommodated, is hermetically connected to an outer portion of the container body 1 via the connecting portion 3. Furthermore, a holder 6 for holding a specimen 5 such as a semiconductor device is installed on an inner wall of the container body 1. A heat-transfer member 10 extends from a cooling portion **10*a* to the heat-insulated container 8 through the connecting portion 3 and penetrates at one end through the side wall of the heat-insulated container 8 so as to be immersed in the cooling medium 9. The heat-transfer member 10 has at the other end the cooling portion 10***a* which is formed into a cylindrical shape in such a manner as to surround the outer periphery of a specimen supporting portion provided at a tip portion of the holder 6. This heat-transfer member 10 is formed of a material which has excellent thermal conductivity, such as copper. An opening 11 for transferring the specimen is provided at a bottom portion of the heat transfer member.

The operation of this embodiment will be described hereafter.

The hermetic container V is coupled hermetically in advance to a vacuum apparatus (not shown). In this state, the coupling portion 2 is opened, and the inside of the hermetic container V is evacuated by using a vacuum pump or the like so that a higher degree of vacuum is thereby established in the hermetic container V. The specimen 5 is then removed from the inside of the vacuum apparatus and supported by the holder 6 inside the container body 1 after being led through the opening 11 into the heat-transfer member 10. Subsequently, the coupling portion 2 is closed.

Thus, the specimen 5 is transferred from the vacuum apparatus into the hermetic container V. At this time, the heat-transfer member 10, one end which leads to the inside of the heat-insulated container 8, is cooled to a low temperature by the cooling medium 9 such as liquid nitrogen in the heat-insulated container 8. In particular, since the heat-transfer member 10 is formed of a material having excellent thermal conductance such as copper, the whole of the heat-transfer member 10 is almost instantly cooled. Consequently, the portion of the specimen 5 surrounded by the heat-transfer member 10 is also cooled, and the pressure of the gas around this portion is lowered. In other words, declines in the degree of vacuum inside the hermetic container V are checked, and as a result, a high degree of vacuum is maintained.

Subsequently, the coupling portion 2 is either opened and the specimen 5 is transferred back to the original vacuum apparatus, or the coupling portion 2 is separated from that vacuum apparatus and coupled with another vacuum apparatus so as to effect the transfer of the specimen 5 thereto. In this case, since no vacuum pump is used unlike the conventional case, a power cable for connecting the vacuum pump to the power source is not needed in this transfer vessel device. Hence, it is possible to freely move the transfer vessel device containing the specimen therein, without being restricted by the range within which a power cable can move.

Thus, the transportation of the specimen 5 between vacuum apparatuses can be effected while being maintained under a high vacuum.

In addition, cooling portion 10*a* of the heat-transfer member 10 may have any configuration insofar as it surrounds the specimen 5. Hence, the cooling portion 10*a* may have a coil-like shape, a box-like shape, or the like, in addition to a cylindrical shape. However, it is still necessary for the cooling portion 10*a* of the heat-transfer member 10 to have an opening for transferring the specimen 5.

Furthermore, the cooling medium 9 which is accommodated in the heat-insulated container 8 should not be restricted to liquid nitrogen, and it is possible to use another cooling medium as well.

As has been described, according to this invention, the atmosphere surrounding a specimen in a hermetic container is cooled by a cooling medium through a heat-transfer member. With this arrangement, it is possible to maintain the inside of the hermetic container under a high vacuum without using a vacuum pump. Accordingly, a power cable together with a vacuum pump, which has been conventionally used, becomes unnecessary so that the transfer vessel device shows excellent transportability. Furthermore, since a vacuum pump is not used, an inexpensive transfer vessel device can be realized.

What is claimed is:

1. A transfer vessel device comprising:

a hermetic container for accommodating a specimen removed from a vacuum apparatus and for supporting said specimen;

a heat-insulated container adapted to accommodate a cooling medium and operatively associated with said hermetic container; and a heat-transfer member adapted to surround said specimen in said hermetic container and one end of which leads into said heat-insulated container so as to be cooled by said cooling medium.

2. A transfer vessel device according to claim 1, wherein said cooling medium comprises liquid nitrogen.

3. A transfer vessel device according to claim 1, wherein said heat-transfer member is formed of copper.

4. A transfer vessel device according to claim 1, wherein said heat-transfer member has a cylindrical shape such as to surround an outer portion of said specimen

5. A transfer vessel device according to claim 1, wherein said hermetic container and said heat-insulated container are integrally connected with each other.

6. A transfer vessel device according to claim 5, wherein the integral connection of said hermetic container and said heat-insulated container is effected via a connecting portion for hermetically connecting said containers.

7. A transfer vessel device according to claim 1 wherein said hermetic container comprises a container body with one end thereof open, and a coupling portion which is provided at said open end of said container body, said coupling portion being adapted to be selectively opened and closed and hermetically connected to the vacuum apparatus.

8. A method of transferring a specimen between vacuum apparatuses comprising the steps of:

hermetically coupling a hermetic container to a first vacuum apparatus in which a specimen is accommodated;

transferring said specimen from said first vacuum apparatus to said hermetic container;

holding said specimen by a holder which is installed in said hermetic container and which is surrounded by a heat-transfer member having one end leading into a heat-insulated container operatively associated with said hermetic container so as to be cooled by a cooling medium accommodated in said heat-insulated container;

separating said hermetic container from said vacuum apparatus with said hermetic container hermetically closed;

hermetically coupling said hermetic container to a second vacuum apparatus; and transferring said specimen from said hermetic container into said second vacuum apparatus.

9. A method of transfer according to claim 8, wherein said specimen is a semiconductor device.

* * * * *